United States Patent [19]

Blanchard

[11] Patent Number: 4,738,076

[45] Date of Patent: Apr. 19, 1988

[54] FASTENER FOR PLASTIC GROCERY SACKS AND DISPENSER THEREFOR

[76] Inventor: David W. Blanchard, 807 Ohio Ave., Long Beach, Calif. 90804

[21] Appl. No.: 25,661

[22] Filed: Mar. 13, 1988

[51] Int. Cl.[4] ..... B65B 7/02

[52] U.S. Cl. ..... 53/138 R; 53/417; 53/480

[58] Field of Search ..... 53/138 A, 138 R, 417, 53/416, 480, 128

[56] References Cited

U.S. PATENT DOCUMENTS 3,780,419 12/1973 Allison et al. ..... 53/138 R X

FOREIGN PATENT DOCUMENTS 964570 5/1957 Fed. Rep. of Germany ..... 53/416

*Primary Examiner*—James F. Coan

*Attorney, Agent, or Firm*—Keith D. Beecher

[57] ABSTRACT

A disk-shaped fastener for engaging the neck of a plastic grocery sack firmly and dependably to hold the sack in a closed condition, and which may easily be applied to the neck of the sack and easily removed therefrom; and a simple applicator for the fastener for use at the check-out stand of a supermarket for quickly and conveniently sliding the fastener over the handle portion of the plastic grocery sack into its fastening position.

8 Claims, 4 Drawing Sheets

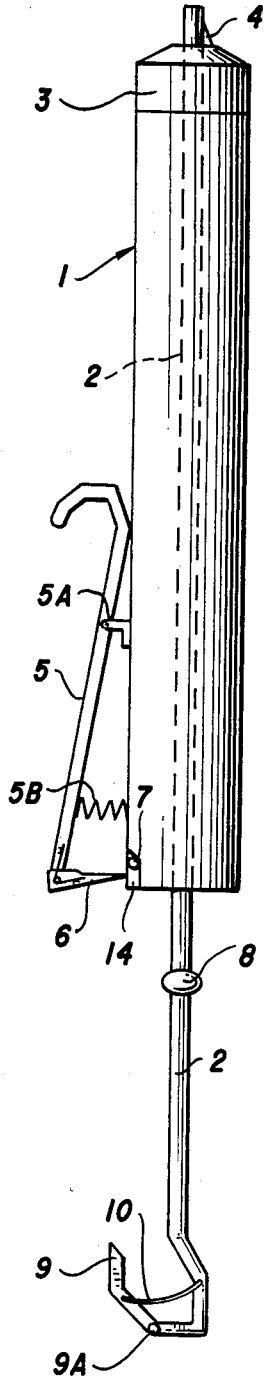
FIG. 2
FIG. 7
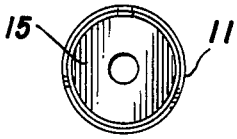
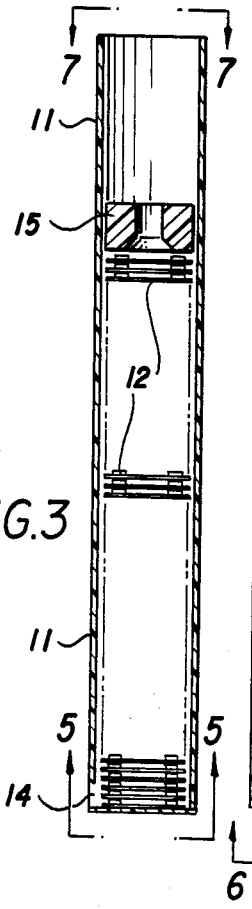
FIG.3
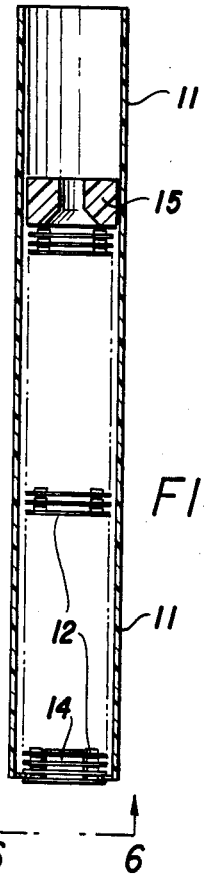
FIG.4
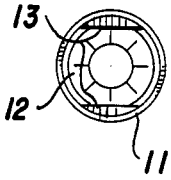
FIG. 5
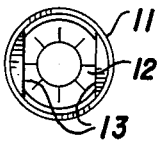
FIG.6

FASTENER FOR PLASTIC GROCERY SACKS AND DISPENSER THEREFOR

BACKGROUND OF THE INVENTION

Paper bags have been used for packing groceries for over a hundred years, and such paper bags have gained wide acceptance by grocery store customers. However, plastic grocery sacks have made inroads into the paper bag market, mainly because they are cheaper and take up less storage space. Also, the plastic sacks are usually equipped with integral handles for easy carrying and, unlike the paper bags, they do not have a tendency to rip open. However, many shoppers complain that the plastic sacks have a greater tendency than paper bags to keel over in the back seat or trunk of a motor vehicle spilling out the contents.

Accordingly, an objective of the present invention is to provide a simple apertured plastic closure disk which may conveniently be slipped over the integral handles and open top of the plastic grocery sack, after the handles have been drawn together, to hold the sacks in a closed condition.

Another objective of the invention is to provide a simple and inexpensive applicator for sliding the fastener disks over the handles and onto the neck of the plastic sacks.

Specifically, the invention provides an apertured closure disk which is intended to be slipped over the mouth portion of a plastic shopping sack when that portion has been drawn together, to hold the neck of the sack firmly in a closed condition; and the invention also provides a simple applicator for the fastener disks.

BRIEF DESCRIPTION OF THE DRAWINGS

FIG. 2 is a side elevational view of an applicator for the fastener disks, likewise constructed in accordance with one embodiment of the invention;

FIGS. 3 and 4 are respective side sectional views of a cartridge which is received in the applicator of FIG. 2, the view of FIG. 4 representing the cartridge turned 90° about its longitudinal axis with respect to the view of FIG. 3;

FIG. 5 is a bottom view of the cartridge taken along the line 5—5 of FIG. 3;

FIG. 6 is a bottom view of the cartridge taken along the line 6—6 of FIG. 3;

FIG. 7 is a top view of the cartridge taken along the line 7—7 of FIG. 3;

DETAILED DESCRIPTION OF THE ILLUSTRATED EMBODIMENT

Figure 1B:
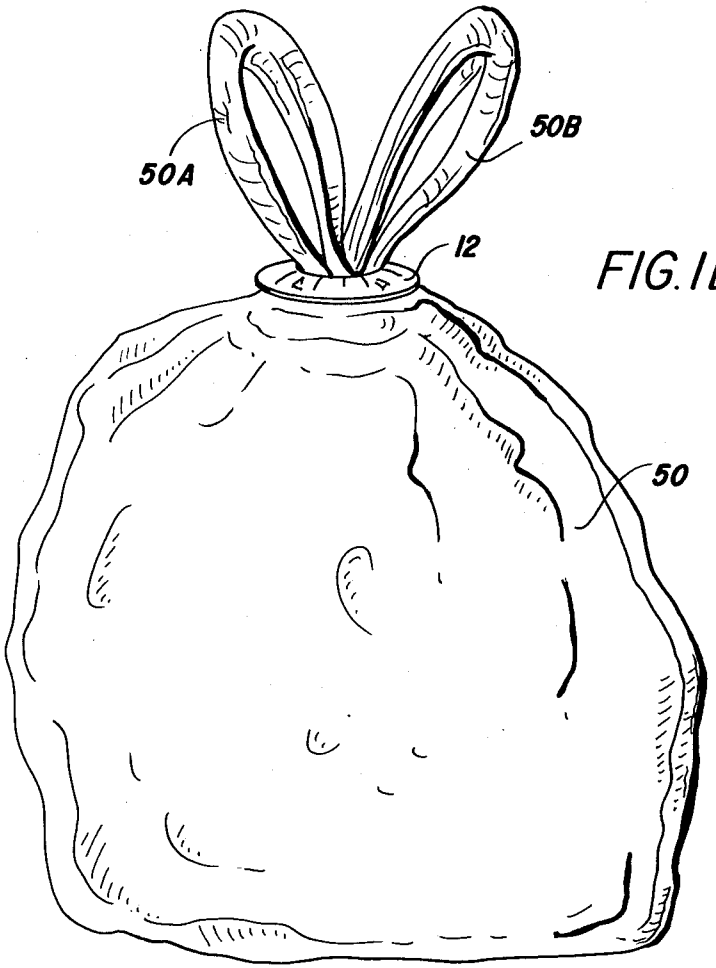
FIG. 1B is a view of the sack of FIG. 1A held in a closed condition by a fastener disk constructed in accordance with one embodiment of the invention.
Figure 1A:
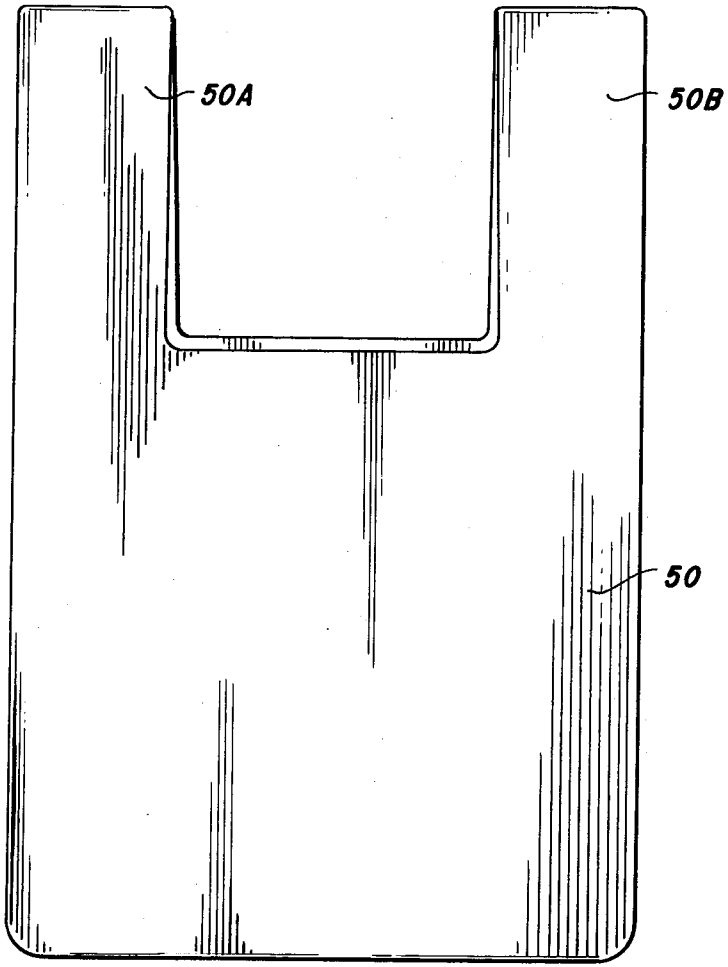
FIG. 1A is a view of a typical plastic grocery sack with integral handles.

FIG. 1A shows a typical plastic grocery sack 50 which, in accordance with conventional practice is equipped with a pair of integral carrying handle portions 50A and 50B. In accordance with the present invention, a fastener disk 12 (FIG. 1B) is slipped over the handle portions 50A, 50B and onto the neck of the sack, firmly to hold the sack in a closed condition when it is filled with groceries. The disk 12 may be easily slipped back over the handle portions 50A, 50B when it is desired to unload the sack.

An applicator mechanism for the disk 12 is shown in FIGS. 2–8C, 10, 11, and 12. As best shown in FIG. 2, the applicator includes an elongated hollow tubular body 1 formed, for example, of plastic or any other appropriate material. A shaft 2 extends coaxially through the tubular body 1 and through a top 3 which is screwed to the tubular body. A spring-loaded release clip 4 couples the shaft to cover 3. As shown in FIG. 2, shaft 2 protrudes downwardly through the lower end of the tubular body 1.

Figure 11:
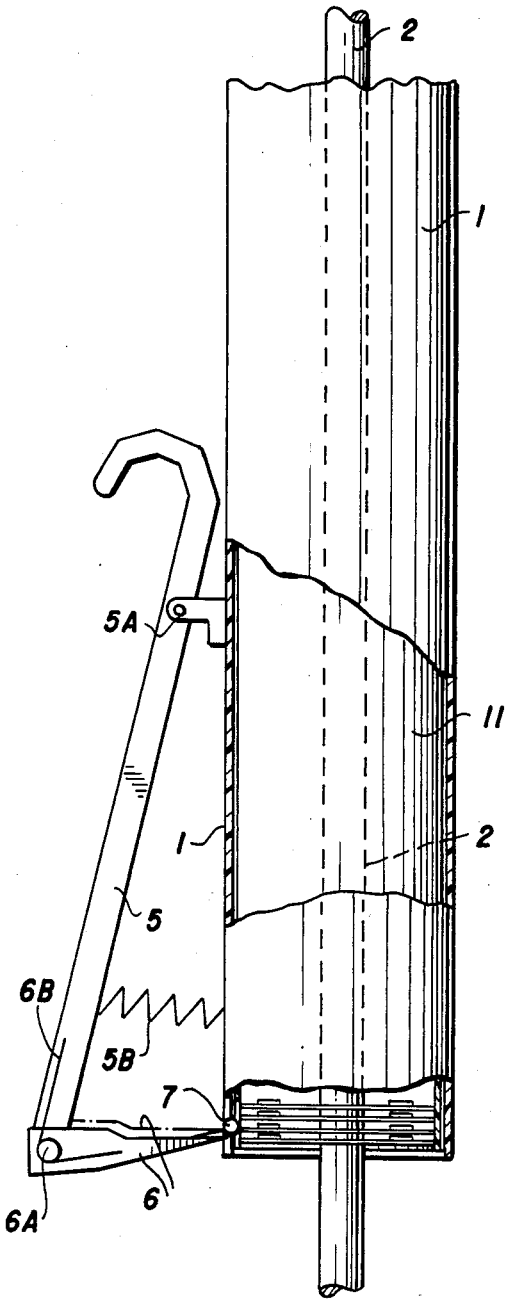
FIGS. 11 and 12 are illustrations of a release handle included in the applicator.
Figure 12:
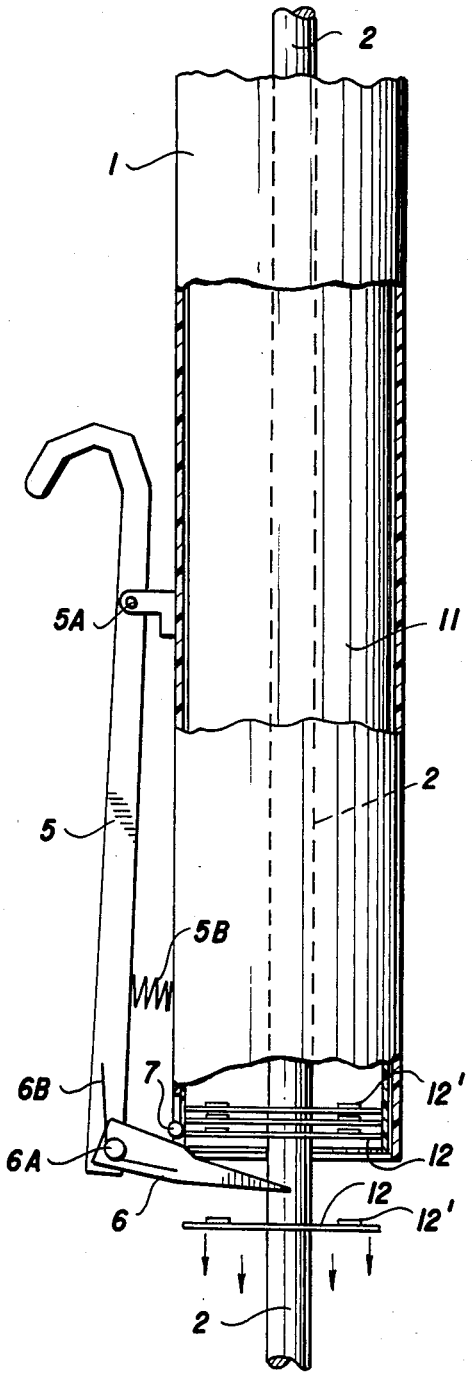

As best shown in FIGS. 11 and 12, the handle 5 is hinged to one side of the tubular body 1 by a hinge 5A. Handle 5 has forks 6 coupled to its lower end by a pin 6A, and the forks are biased in a counterclockwise direction by a spring 6B. The handle is spring-biased about the hinge 5A by a spring 5B. The handle causes a single disk 12 to be released when it is operated. A smooth metal bar 7 is mounted at the lower end of one side of the tubular body 1 to be engaged by the forks 6.

Figure 8A:
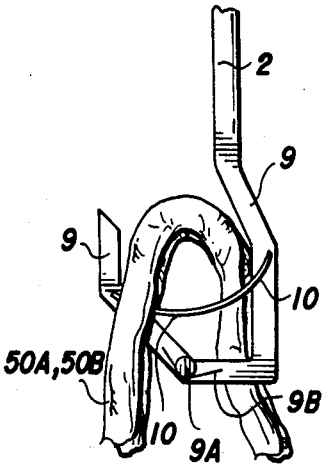
FIGS. 8A, 8B, and 8C are fragmentary schematic sketches showing the manner in which the applicator of FIG. 2 operates to apply a fastener disk over the handles of the plastic grocery sack.

A stopper 8 is mounted on the lower end of shaft 2, as shown in FIG. 2. A hook 9 is pivoted to the lower end of the shaft by a pivot pin 9A, as also shown in FIG. 2. A filament 10 extends across the hook. The hook 9 is hooked under the handles 50A and 50B of the bag 50, as shown in FIG. 8A. As the shaft 2 is moved upwardly, the handles engage the filament 10 and draw the hook closed, as it pivots about pin 9A against the force of a spring 9B. This action causes the hook to assume the closed position of FIG. 8B. With the hook in the closed condition, a disk-like fastener 12 may be moved down past stop 8 (FIG. 2), over the hook and over the handles 50A, 50B, and into the position shown in FIG. 1B, to hold the sack closed.

Figure 9A:
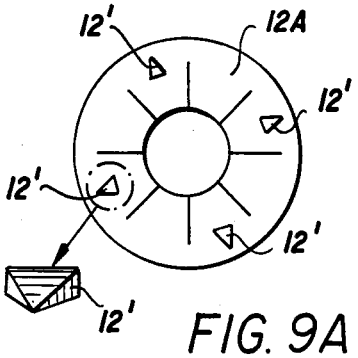
FIGS. 9A and 9B are respective bottom views of two types of fastener disks constructed in accordance with the invention, and which may be used in the applicator and dispenser of FIG. 2.
Figure 9B:
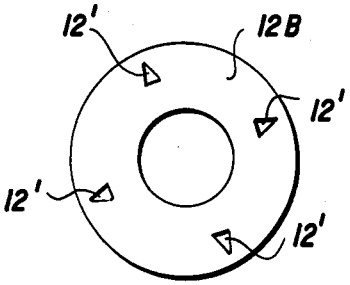

The disk-like fasteners 12 may be formed of plastic and, as shown in FIGS. 9A and 9B are formed to have a disk-like configuration with a central aperture. A relatively small aperture is shown in FIG. 9A, with radial slits extending from the aperture partially across the disk 12A. The disk 12B in FIG. 9B has a somewhat larger aperture, and does not have the radial slits. A plurality of spacers 12' are mounted on one side of the disks, as shown in FIGS. 9A and 9B, and these elements serve to space the disks as the disks are loaded into a cartridge 11 (FIGS. 3–6). The disks are stacked in the cartridge and are held in a stacked condition by the retaining ridges 13 as best shown in FIGS. 5 and 6.

Figure 10:
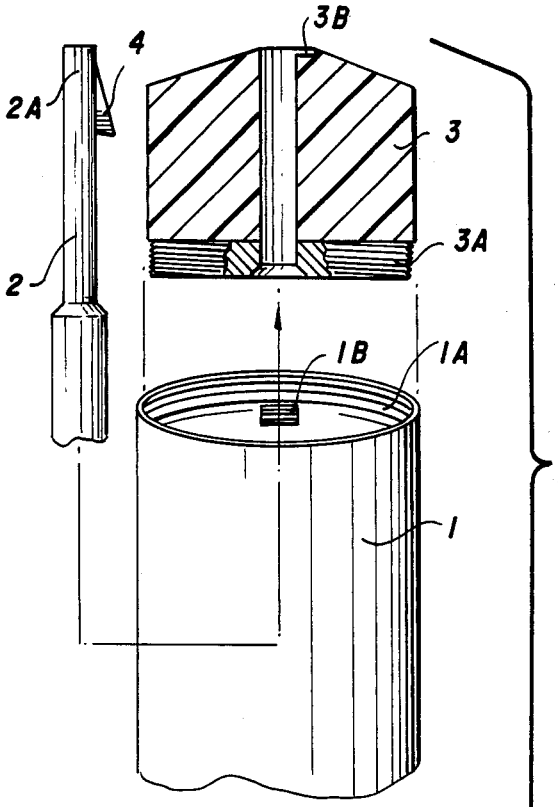
FIG. 10 is a fragmentary enlarged view of the upper portion of the applicator, showing the manner in which various components of the applicator are attached and coupled to one another.

As best shown in FIGS. 11 and 12, the cartridge 11 is inserted into the tubular body 1 in coaxial relationship with the body and with the shaft 2. To insert the cartridge, the top 3 of the shaft is unthreaded from the body, as shown in FIG. 10. As shown in FIG. 10, the body 1 has internal threads 1A at its upper end, and the top 3 has external threads 3A which are threaded into the threads 1A when the cover is in place. Shaft 2 extends down through the cover and through the body 1, as described above. The body 1 has an internal tab 1B, as shown in FIG. 10, which matches a tab on cartridge 11 for proper allignment.

As also shown in FIG. 10, shaft 2 has a bevelled portion 2A at its upper end which extends tnrough the top 3, and the spring-biased clip 4 engages a notch 3B and top 3 so that the shaft 2 may be firmly held in place in the body 1 with the forks 6 of hook 5 aligned with an opening 14 in the lower end of the body, as best shown in FIG. 2.

When a new cartridge is to be loaded into the tubular body 1, the clip 4 is pressed inwardly to release the shaft 2, to permit the top 3 to be unscrewed from the body 1, so that the empty cartridge 11 may be removed, and a new cartridge inserted. A relatively large spacer 15 is positioned at the top of the cartridge 11.

Figure 8B:
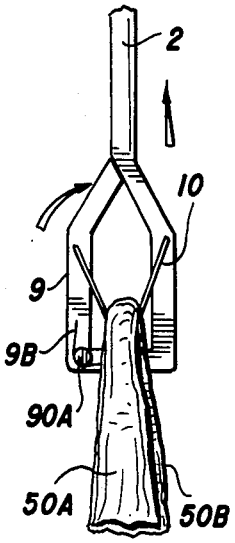
Figure 8C:
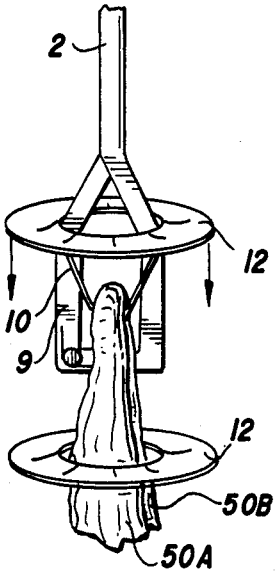

In the operation of the applicator, the handles 50A, 50B of the plastic sack (FIG. 1A) are removed from the wire frame at the checkout stand which is used to support the sack during loading. The applicator is taken in hand, and handle 5 is pressed. A single disk 12 is thereby released from the bottom of the cartridge 11, and rides down the shaft 2 until it is stopped by the stopper 8. The hook 9 is passed through the two handles 50A, 50B as shown in FIG. 8A, and pulled upwardly. The pressure of the bag handles on filament 10 causes the hook to close over the bag handles, as shown in FIG. 8B. The disk 12 can then be slid by hand past stopper 8, over the hook and handles, as shown in FIG. 8C, into its final position shown in FIG. 1B.

FIGS. 3–7 show a stack of disks 12 inside the cartridge 11. The cartridge 11 is a simple tube. The ends are open, with retaining ridges 13 positioned at the lower end. These ridges hold the disks 12 inside the cartridge until they are needed. The upper end of the cartridge is closed except for a central hole large enough for shaft 2 easily to pass through. The cartridge goes inside the main tubular body 1, as shown in FIGS. 11 and 12, and the shaft 2 passes through both the cartridge 11 and the body 1. The hole 14 in the side of both the cartridge 11 and tubular body 1 allows the separating forks 6 access to the disks 12. A tab on the top sealer of the cartridge fits into a slot 1B (FIG. 10), as explained above to assure that the access hole 14 lines up with forks 6.

The thick spacer 15 is positioned inside the cartridge 11, as shown in FIGS. 3 and 4 on top of the stack of disks 12. The spacer 15 is slightly larger in diameter than the disks. This spacer serves to keep the shaft centered in the cartridge 11 when the stack of disks 12 is low, and isolates the disks from any radial pressure that may be applied to the shaft during operation. As shown in FIGS. 3 and 4, the inside hole of the spacer is bevelled to help guide the shaft through the cartridge.

FIG. 10 shows details as to how the shaft 2 and top 3 are held together by the quick release clip 4. When it is time to replace a spent cartridge of disks, the shaft 2 is removed from the tubular body 1 by pressing the release clip 4 and pulling the shaft out of the top 3 and through the bottom of the main body 1. The top 3 is then unscrewed from the main body, the old cartridge removed, and a new cartridge is loaded. The tab on top of the cartridge is aligned with the slot 1B in the main body to assure that the disk releasing mechanism will work properly, and also to prevent loading the cartridge upside down.

Once the new cartridge is in place. the top is screwed back on and the shaft is inserted up through the cartridge, through the stack of disks, through the thick spacer 15, and through the top 3. When the shaft is properly seated against the bevelled edge of the top (FIG. 10), the quick release clip 4 pops out and the shaft is securely held in position. This assures that hook 9 is properly positioned relative to the release handle 5.

Details of the disks themselves are shown in FIGS. 9A and 9B. There are two basic designs, designated 12A and 12B. In both designs the disks are preferably made of plastic, with a thickness of about 1/32nd of an inch. The disks have a relatively large hole in the center, and have small triangular spacers 12′ on one side. These spacers provide room between the disks when in the cartridge 11, as shown in FIGS. 3 and 4, permitting the insertion of the separating forks 6 between the disks.

Disk 12A requires that radial slots be cut in the disk to allow it to pass over stopper 8 and the closed hook 9. Disk 12B does not require radial slits, as the hole is large enough to accommodate the closed hook 9. The stopper 8 of FIG. 2 has a different configuration when disk 12B is used, and may be formed of two spring-loaded arms which fold in towards the shaft when the disk is passed over it.

The operation of the release handle 5 is shown in FIGS. 11 and 12. As described above, the separating forks 6 are hinged to the lower end of handle 5 and are held in the standby position of FIG. 11 by springs 5B and 6B. When in the standby position, the tips of the separating forks rest on the smooth metal bar 7, which extends across the disk access opening 14. The metal bar 7 positions the tips of the forks so that they are positioned between the first and second lowermost disks in the cartridge. The separating forks are shaped in such a way that when handle 5 is pressed to the position shown in FIG. 12, the separating forks 6 peal off the lowermost disk 12 and force it past the retaining ridges 13 shown in FIGS. 5 and 6.

The invention provides, therefore, an improved plastic disk which is passed over the handles of a plastic grocery sack by the applicator described above, and which serves to hold the sack conveniently in a closed position after the sack has been loaded with groceries.

It will be appreciated that while particular embodiments of the disk, and a particular embodiment of the applicator have been shown and described, modifications may be made. It is intended in the claims to cover all modifications which come within the true spirit and scope of the invention.

I claim:

1. An applicator for use in conjunction with a plastic grocery sack, said sack having an open top and an integral plastic handle portion adjacent to said open top, and said applicator enabling an apertured closure disk to be moved over the handle portion of the plastic grocery sack and over the open top to close and fasten the sack, said applicator comprising: an elongated tubular body; a shaft extending coaxially through said body and protruding down through the lower end thereof; a stack of apertured closure disks positioned coaxially within said tubular body with said shaft extending through the apertures in said disks; a release handle pivotally mounted on said tubular body; fork means coupled to said handle in position to pass between the two lowermost disks in said tubular body and release the lowermost disk when said release handle is operated; and a hook mounted on the lower end of said shaft to receive the handle portion of the plastic sack to permit the released disk to be manually moved down said shaft and over said hook and handle portion to close and fasten the open top of the sack.

2. The applicator defined in claim 1, in which said hook includes a pivotally movable arm portion, and means for causing said arm portion to rotate to a closed position when the hook receives the handle portion of the sack.

3. The applicator defined in claim 1, and which includes a top threaded to the upper end of said tubular body, with the upper end of said shaft extending through a central hole in said top.

4. The applicator defined in claim 1, and which includes a spring-loaded release clip mounted on the upper end of said shaft for releasably engaging said top releasably to maintain said shaft in said tubular body.

5. The applicator defined in claim 1, and which includes ridge means mounted at the lower end of said tubular body to retain the stack of disks within the body.

6. The applicator defined in claim 1, in which the disks are contained in a cartridge positioned in said tubular body in coaxial relationship therewith, with said shaft extending through said cartridge.

7. The applicator defined in claim 1, in which said shaft has a stop thereon to prevent free motion of the released disk down along the shaft, but to permit the released disk to be moved past said stop upon the application of manual force.

8. A closure disk assembly for a plastic grocery sack, said sack having an open top and an integral plastic handle portion adjacent to said open top, and said disk assembly comprising: a flat disk-like member having a central hole therein for receiving the handle portion of the sack and to permit the disk-like member to be moved down over said handle portion and over the open top of the sack to close and fasten the sack; and at least one spacer member mounted on one side of said disk-like member to permit a plurality of such disk-like members to be stacked in coaxial relationship on top of one another and to be axially spaced from one another, in which said disk-like member includes a plurality of radial slits extending from the peripherey of the hole toward the outer periphery of the disk-like member.

* * * * *